US005402851A

United States Patent [19]

Baiton

[11] Patent Number: 5,402,851

[45] Date of Patent: Apr. 4, 1995

[54] HORIZONTAL DRILLING METHOD FOR HYDROCARBON RECOVERY

[76] Inventor: Nick Baiton, 4144-42 Street Southwest, Alberta, Canada, T3E 3N3

[21] Appl. No.: 56,663

[22] Filed: May 3, 1993

[51] Int. Cl.[6] ..... E21B 43/00

[52] U.S. Cl. ..... 166/369; 166/52

[58] Field of Search ..... 166/369–372, 166/245, 52, 313, 368, 366, 381

[56] References Cited

U.S. PATENT DOCUMENTS

| | | | |
|---|---|---|---|
| 3,386,508 | 6/1968 | Bielstein et al. | 166/52 X |
| 4,463,988 | 8/1984 | Bouck et al. . | |
| 4,607,888 | 8/1986 | Trent et al. . | |
| 4,611,855 | 9/1986 | Richards . | |
| 4,753,485 | 6/1988 | Goodhart . | |
| 5,082,054 | 1/1992 | Kiamanesh . | |

*Primary Examiner*—Michael Powell Buiz
*Attorney, Agent, or Firm*—Jerry T. Kearns

[57] ABSTRACT

A method for recovering fluids such as crude oil, associated solution gas, formation water, injected water, natural gas and other gases, and natural gas liquids, from a hydrocarbon producing reservoir or formation in which fluids collected in one or more substantially horizontal wells are routed to the surface through a substantially vertical wellbore. The method may be employed in connection with entirely new well systems, by drilling a vertical wellbore to intersect or penetrate the producing formation in close proximity to one or more existing horizontal wells, or by drilling one or more horizontal wells to intersect or terminate in close proximity of an existing vertical wellbore. Preferably, the vertical wellbore extends to a depth greater than the depth of intersection with the horizontal well or wells, forming a sump for the collection of fluids.

20 Claims, 2 Drawing Sheets

HORIZONTAL DRILLING METHOD FOR HYDROCARBON RECOVERY

BACKGROUND OF THE INVENTION

1. Field of the Invention

The present invention relates to methods for hydrocarbon recovery, and more particularly pertains to a method for recovering subterranean oil and gas.

2. Description of the Prior Art

Various drilling methods have been practiced for the recovery of subterranean oil and gas. Initially, for relatively new fields, it is frequently necessary merely to drill a vertical well into a producing reservoir or formation. As such easily producible fields are becoming increasingly depleted, there has been great interest in increasing production from depleted or semi-depleted fields, and from fields where the least expensive methods of production have been found inadequate. U.S. Pat No. 4,463,988 which issued to Bouck et al. on Aug. 7, 1984 discloses a method for recovering hydrocarbons from tar sand deposits in which steam is injected into bore holes extending laterally from a vertical shaft. The steam causes the tar sands to become viscous and flow by gravity into the bore holes. U.S. Pat. No. 4,607,888 which issued to Trent et al. on Aug. 26, 1986 discloses a method for recovering hydrocarbons in which water occurring in the hydrocarbon formation is used to wash fluid hydrocarbons from a porous formation by injecting the water into bore holes extending from an underground tunnel or shaft. U.S. Pat. No. 4,611,855 which issued to Richards on Sep. 16, 1986 discloses a method for collecting subterranean methane in which lateral bore holes drilled at axially spaced locations along a vertical shaft collect and conduct methane to the shaft for extraction. U.S. Pat. No. 4,753,485 which issued to Goodhart on Jun. 28, 1988 discloses a method for extracting oil in which a plurality of deviated wells extend upwardly and outwardly from a vertical shaft. Steam injected into the deviated wells causes oil to drain through the deviated wells into the vertical shaft for collection. U.S. Pat. No. 5,082,054 which issued to Kiamanesh on Jan. 21, 1992 discloses a method for oil extraction in which microwave irradiation is employed in conjunction with a plurality of horizontal canals connected to a central vertical well.

SUMMARY OF THE INVENTION

The instant application discloses a method for recovering hydrocarbons from underground reservoirs and formations in which fluids are produced in horizontal wells, but instead of the fluids being routed conventionally up the wellbore to the surface in the horizontal wellbore, they are instead routed into an interconnecting vertical wellbore or one that penetrates the producing formation in close proximity of the horizontal wellbore. Thereafter, they are then produced to the surface either by flowing utilizing reservoir energy or by pumping utilizing artificial lift equipment. The process is applicable for producing fluids which may be present in a hydrocarbon reservoir including crude oil, associated solution gas, formation water, water which may have been injected into the formation, natural gas and other gases, and natural gas liquids. The method of the instant invention includes the steps of drilling one or more horizontal wells such that the horizontal well intersects or terminates in close proximity of an existing or newly drilled vertical wellbore or drilling a vertical well specifically to intersect or penetrate the producing formation in close proximity to an existing or newly drilled horizontal wellbore, routing fluid produced in the one or more horizontal wells to the vertical wellbore, and producing the recovered fluids to the surface in the vertical wellbore utilizing reservoir energy or artificial lift equipment.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENT(S)

Figure 1:
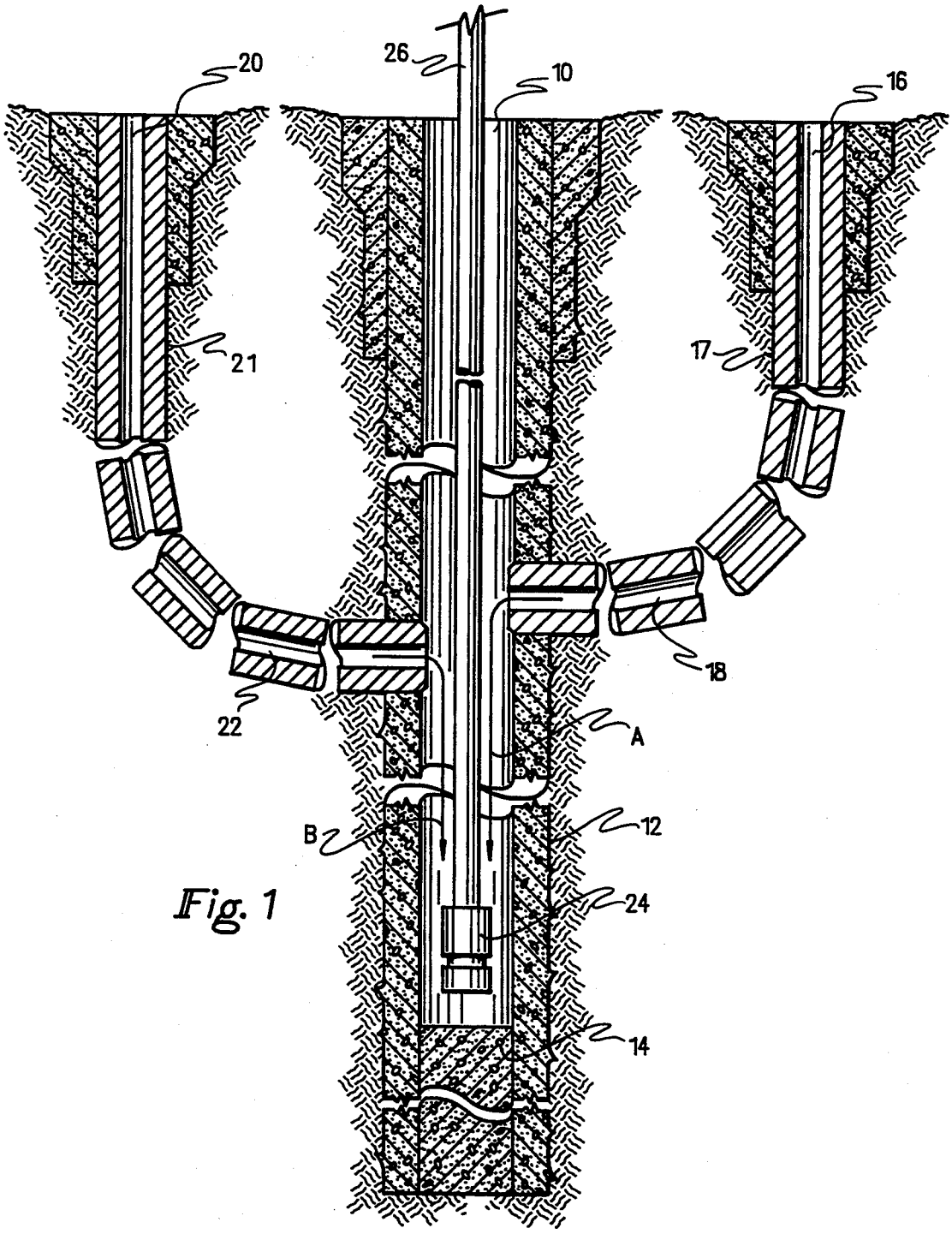
FIG. 1 is a diagrammatic cross-sectional view taken along a vertical plane and illustrating an example well system for producing hydrocarbons according to the method of the present invention.
Figure 2:
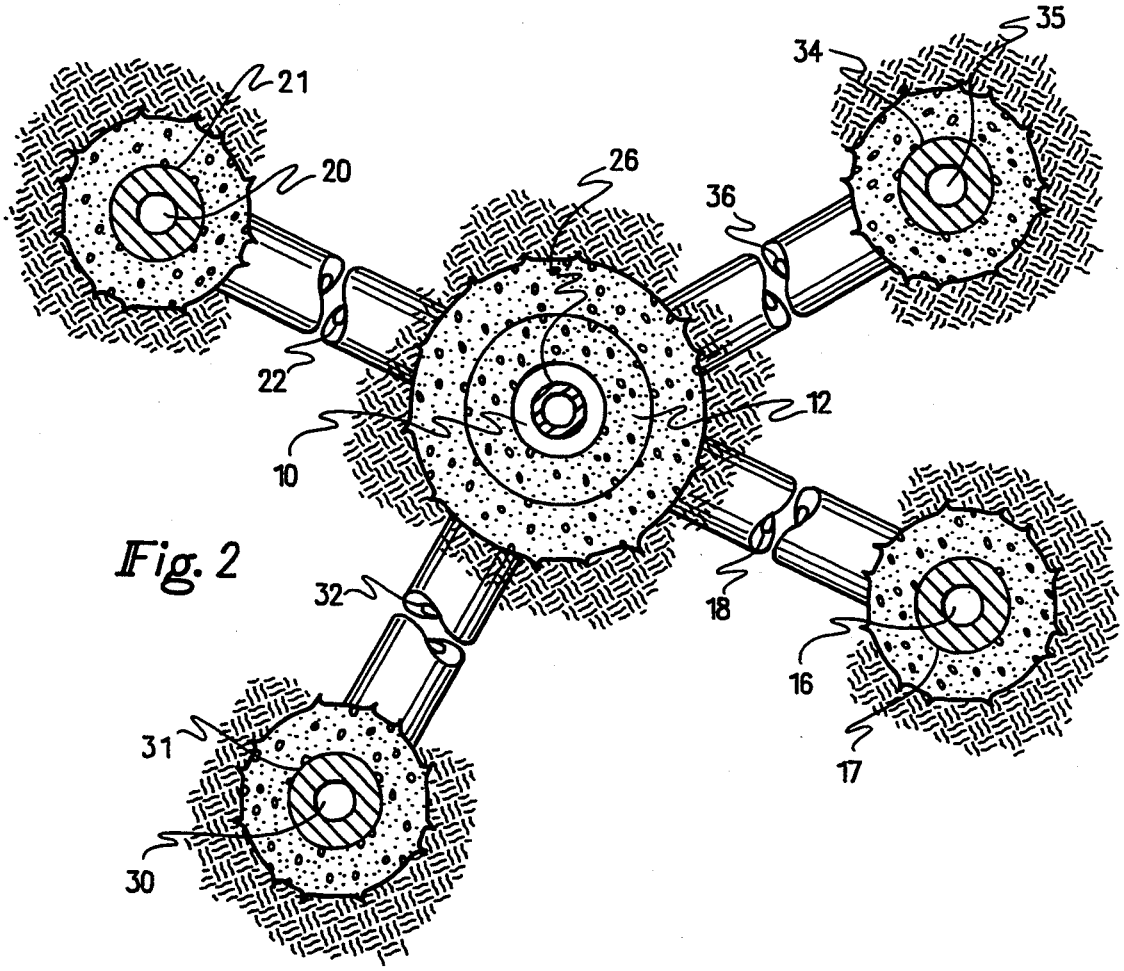
FIG. 2 is a diagrammatic cross-sectional view taken along a horizontal plane and further illustrating the example well system of FIG. 1.

Referring now to the drawings, wherein like reference numerals designate corresponding structure throughout the views, and referring in particular to FIGS. 1 and 2, an improved method for hydrocarbon recovery 10 according to an example embodiment of the invention includes a vertical wellbore 12 conventionally provided with a porous casing 12. The wellbore 14 may be plugged at a desired depth by a plug 14, dependent upon the location of pay zones within the reservoir or formation. A plurality of horizontal wells 16, 20, 30, and 34 include respective non-porous sections of casings 17, 21, 31, and 35, and porous sections of casing or open hole 18, 22, 32, and 36 each intersecting or terminating in close proximity to the vertical wellbore 10, at the same or different depths. Within the scope of this description, the term "horizontal well" means a well which includes a substantially horizontal portion, such as horizontal porous or open hole portion 18 of well 16, or the horizontal porous open hole portion 22 of well 20. Such horizontal wells are drilled from the surface utilizing conventional equipment such that the horizontal wells include an initially vertical portion which curves and becomes a horizontal portion of the wellbore. In accordance with conventional methods, horizontal wells have been previously employed by collecting fluids in the horizontal portion of the well and by routing collected fluids to the surface via the vertical portion of the horizontal well, utilizing reservoir energy or artificial lifting equipment. In accordance with the instant invention, fluids collected in the horizontal wells drain by gravity or reservoir pressure through the porous section of casing or open hole into the vertical wellbore 10, as indicated by arrows A and B, which advantageously extends to a depth below both the pay zone and the intersections with the horizontal wells, forming a sump for the collected fluids. A pump 24, such as an electric submersible pump, may be provided in the sump for producing collected fluids to the surface through conduit 26.

The method of the present invention may be employed in connection with entirely new well systems, or to improve the production of an existing installation by drilling a vertical wellbore to intersect one or more existing horizontal wells, or by drilling one or more horizontal wells to intersect or terminate in close proximity to an existing vertical wellbore.

In the inventive system, fluid production from a hydrocarbon formation or reservoir enters a horizontal wellbore through perforations or openings in the pipe and migrates through the horizontal portion of the horizontal wellbore into an interconnecting vertical wellbore or vertical wellbore in close proximity at the far end of the horizontal wellbore. One or more horizontal wells are drilled to intersect an existing vertical wellbore or a vertical wellbore drilled specifically for this purpose. Production of fluids from a hydrocarbon reservoir utilizing this combination of wells involves routing produced fluids through the opposite end of the horizontal wellbore as compared to the conventional method in which the produced fluids enter the horizontal portion of the wellbore and are routed up the tubular pipe to the surface through the vertical end of the conventional horizontal well. Producing fluids from a hydrocarbon reservoir with the inventive system is technically, practically and mechanically more efficient than producing the same fluids through either a longer, curved conventional horizontal wellbore or through a single conventional vertical wellbore. Accordingly, the inventive method achieves many advantages, some of which are described in detail below.

Less energy is required to lift the produced fluids to the surface in the inventive system in the shorter interconnecting vertical well than that which would be required to lift the same volume through the longer, curved horizontal and vertical portions of the wellbore due to lower friction of the fluids inside the tubular production pipes. Over the life of a reservoir or field, the energy saved with the inventive system would be significant. In the later life of a reservoir or field, when formation pressures have declined to the point where insufficient pressure energy remains to cause the fluids to flow or to be easily lifted, there would be a significant saving in operating costs associated with the inventive system as compared to the costs to produce conventional separate vertical or individual horizontal wells. In the inventive system, production rates would be higher from the same formation than those for conventional wells because of the more efficient use of reservoir energy. Reservoir pressure or energy required to drive the produced fluids from the reservoir into the horizontal portion of the horizontal well and out of the lower end into the vertical wellbore or in close proximity to the vertical wellbore would be much lower than that required to drive or lift the fluids up the wellbore of the horizontal well.

Capital costs associated with the inventive system would be considerably lower as a result of the following:

(a) More than one horizontal well can be interconnected to the same vertical wellbore. For instance, should there be four horizontal wells interconnected to one vertical wellbore, only one instead of four sets of downhole production equipment and only one set of surface facilities would be needed.

(b) The flowline pipe required to transport produced fluids to a central storage facility is reduced for a multi-well of the inventive system as compared to a conventional system resulting in a saving in capital costs. Surface disturbances associated with the pipelines in a multi-well formed pursuant to the inventive system are substantially reduced, since fewer producing wells are required.

(c) By strategic planning of the surface locations for a multi-well field utilizing the inventive concept, few surface locations are required since it is possible to drill several wells from one surface location, thus greatly reducing capital costs for lease construction and ongoing lease rental costs. By reducing surface disturbance, there is less of an impact on the environment.

(d) For reservoirs containing low gravity and highly viscous crude oil, utilizing the inventive system has a significant positive advantage over conventional systems since the reservoir energy required to drive the fluids into the wellbore is reduced. In the inventive system, the back pressure against which the reservoir must produce can be virtually eliminated through the utilization of artificial lift equipment resulting in increased production. It is possible to draw down the level of the production fluid in the vertical wellbore by means of pumping or artificial lift equipment so that the level of the fluids remains below the producing formation in the vertical wellbore of the inventive system. Production capability of the reservoir is thus greater, especially in the latter stages of those fields where reservoir pressure has declined to the extent that insufficient energy remains to lift the produced fluids to the surface. Under conventional production techniques using single vertical wells, the ability of the reservoir to drive fluids into a wellbore is much lower than that for the inventive system because of the much lower area contacted by the vertical wellbore. Well servicing, lifting and operating costs are higher for conventional horizontal wells because of the difficulty and expense associated with lifting the production from within and/or below the curved portion of the horizontal wellbore. Reducing or eliminating these costs through the use of the inventive system would amount to a very significant saving over the life of a producing field. When operating costs exceed revenue, it is necessary to abandon producing wells in a field which results in a larger portion of the hydrocarbons remaining unrecovered in the formation under conventional production systems as compared to the inventive system. Capital costs for drilling conventional horizontal wells are higher since larger diameter borings are required to accommodate larger tubular goods associated with the conventional horizontal wells being produced through the vertical portion of the horizontal well. Also, capital costs for flowlines and production equipment can be reduced or eliminated through utilization of the inventive system.

(e) With the inventive system, the horizontal well or wells interconnected or terminating in close proximity to the central vertical well can be utilized as observation wells to monitor surface and downhole pressures on a continuous or regular basis, thus allowing for better management of the reservoir with resulting improved reservoir performance.

(f) In the inventive system, the lower or face end of the horizontal wellbore can be isolated from the interconnecting vertical wellbore in order to perform workovers or stimulations on the formation without disrupting production from other wells producing into the same central vertical wellbore.

(g) In the inventive system, utilizing one central vertical wellbore to collect production from several horizontal wells, the central vertical well can be sized to produce greater volumes than is possible utilizing conventional vertical or horizontal wells. By utilizing larger diameter tubular goods, in the vertical wellbore, downhole production equipment can be sized to produce the larger volumes associated with the inventive system. The ability to utilize artificial lift equipment capable of larger volumes such as electric driven submersible pumps to produce the vertical well in the inventive system has economic benefits over conventional methods of production. By drilling the central vertical well sufficiently deep such that a sump is created below the point of intersection of the horizontal wellbore with the vertical wellbore, produced fluids could be lifted or pumped by means of high volume artificial lift equipment which could result in higher production volumes than is possible with conventional wells. Production can be more continuous and stable than that possible utilizing a conventional system in the latter stages in the life of a field.

(h) Should there be more than one pay zone in the area surrounding the central vertical wellbore, and should there be a need to segregate production from each of two or more pay zones, it may be more economical to use a separate multi-well system pursuant to the invention for each pay zone or, if desirable, the central vertical well can be dually completed utilizing downhole packers and more than one production tubing string.

In situations where a conventional horizontal producing well exists, an intersecting vertical well can be drilled to create a two-well system or a multi-well system by extending existing horizontal wellbores such that they intersect or terminate in close proximity to the vertical wellbore, pursuant to the method of the present invention. The direction of the produced fluids would be reversed in the existing horizontal wellbore and be routed into the interconnecting vertical wellbore and to the surface as in the inventive system explained herein. It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method for recovery of conventional non-viscous oil and associated fluids from hydrocarbon formations or reservoirs without the injection of external fluids, comprising the steps of:

drilling a substantially vertical wellbore into a hydrocarbon reservoir or formation containing non-viscous oil and associated hydrocarbon fluids;

drilling from the surface at least one well including a substantially horizontal portion intersecting or terminating in close proximity to said vertical wellbore;

collecting fluids from said reservoir or formation in said at least one well;

routing fluids collected in said at least one well into said substantially vertical wellbore;

conducting said fluids to the surface in said substantially vertical wellbore.

2. The method for hydrocarbon recovery of claim 1, wherein said substantially vertical wellbore extends to a depth substantially greater that the depth of intersection with said at least one well, forming a sump in said substantially vertical wellbore for collection of fluids.

3. The method for hydrocarbon recovery of claim 1, wherein said substantially vertical wellbore extends to a depth below a pay zone of said reservoir or formation.

4. The method for hydrocarbon recovery of claim 1, wherein said fluid consists of one or more of the following: crude oil, associated solution gas, formation water, injected water, natural gas and other gases, and natural gas liquids.

5. The method for hydrocarbon recovery of claim 1, further comprising the step of drilling a plurality of wells each including a substantially horizontal portion intersecting said substantially vertical wellbore.

6. The method for hydrocarbon recovery of claim 5, wherein said plurality of wells intersect or terminate in close proximity to said substantially vertical wellbore at different depths.

7. The method for hydrocarbon recovery of claim 5, wherein said plurality of wells intersect or terminate in close proximity of said substantially vertical existing wellbore at different depths.

8. The method for hydrocarbon recovery of claim 1, wherein said step of conducting said fluids to the surface in said substantially vertical wellbore includes the step of raising said fluids using artificial lift equipment.

9. The method for hydrocarbon recovery of claim 1, wherein said step of conducting said fluids to the surface in said substantially vertical wellbore includes the step of flowing said fluids using reservoir energy.

10. A method for recovery of conventional non-viscous oil and associated fluids from hydrocarbon formations or reservoirs without the injection of external fluids in which an existing well in a reservoir or formation includes a substantially horizontal portion, and fluids collected in said existing well are routed to the surface through a substantially vertical portion of said existing well, comprising the steps of:

drilling a substantially vertical wellbore into said hydrocarbon reservoir or formation containing non-viscous oil and associated fluids such that said substantially vertical wellbore intersects or terminates in close proximity of said substantially horizontal portion of said existing well;

collecting fluids from said reservoir or formation in said existing well;

routing fluids collected in said existing well into said substantially vertical wellbore; and conducting said fluids to the surface in said substantially vertical wellbore.

11. The method for hydrocarbon recovery of claim 10, wherein said substantially vertical wellbore extends to a depth below a pay zone of said reservoir or formation.

12. The method for hydrocarbon recovery of claim 9, wherein said fluid consists of one or more of the following: crude oil, associated solution gas, formation water, injected water, natural gas and other gases, and natural gas liquids.

13. The method for hydrocarbon recovery of claim 9, wherein said step of conducting said fluids to the surface in said substantially vertical wellbore includes the step of flowing said fluids using reservoir energy.

14. The method for hydrocarbon recovery of claim 9, wherein said step of conducting said fluids to the surface in said substantially vertical wellbore includes the step of raising said fluids using artificial lift equipment.

15. The method for hydrocarbon recovery of claim 10, wherein said substantially vertical wellbore extends to a depth substantially greater that the depth of intersection with said existing well, forming a sump in said substantially vertical wellbore for collection of fluids.

16. A method for recovery of conventional non-viscous oil and associated fluids from hydrocarbon formations or reservoirs without the injection of external fluids in which an existing substantially vertical wellbore extends in a reservoir or formation, comprising the steps of:

drilling from the surface at least one well into said hydrocarbon reservoir or formation containing non-viscous oil and associated hydrocarbon fluids including a substantially horizontal portion such that said substantially horizontal portion intersects or terminates in close proximity of said substantially vertical existing wellbore;

collecting fluids from said reservoir or formation in said well;

routing fluids collected in said well into said substantially vertical existing wellbore; and conducting said fluids to the surface in said substantially vertical existing wellbore.

17. The method for hydrocarbon recovery of claim 16, wherein said substantially vertical existing wellbore extends to a depth below a pay zone of said reservoir or formation.

18. The method for hydrocarbon recovery of claim 16, wherein said fluid consists of one or more of the following: crude oil, associated solution gas, formation water, injected water, natural gas and other gases, and natural gas liquids.

19. The method for hydrocarbon recovery of claim 16, further comprising the step of drilling a plurality of wells each including a substantially horizontal portion intersecting said substantially vertical existing wellbore.

20. The method for hydrocarbon recovery of claim 16, wherein said substantially vertical existing wellbore extends to a depth substantially greater that the depth of intersection with said at least one well, forming a sump in said substantially vertical existing wellbore for collection of fluids.

* * * * *